US006142209A

United States Patent [19]

Girard

[11] Patent Number: 6,142,209

[45] Date of Patent: Nov. 7, 2000

[54] CLOSED BOX MOTORIZED WINDOW AWNING

[75] Inventor: Larry Girard, Dana Point, Calif.

[73] Assignee: Girard Systems, Inc., Irvine, Calif.

[21] Appl. No.: 09/444,118

[22] Filed: Nov. 19, 1999

[51] Int. Cl.[7] ..... E04F 10/06

[52] U.S. Cl. ..... 160/22; 160/66

[58] Field of Search ..... 160/22, 66, 67, 160/72, 73, 81, 47, 310; 135/88.11, 88.12

[56] References Cited

U.S. PATENT DOCUMENTS

| | | | |
|---|---|---|---|
| 4,160,458 | 7/1979 | Marcellos | 135/5 |
| 4,164,972 | 8/1979 | Bennett | 160/66 |
| 4,180,117 | 12/1979 | Greer | 160/67 |
| 4,615,371 | 10/1986 | Clauss | 160/22 |
| 4,862,940 | 9/1989 | Atchison | 160/67 |
| 4,941,524 | 7/1990 | Greer | 160/67 |
| 5,044,416 | 9/1991 | Murray | 160/72 |
| 5,171,056 | 12/1992 | Faludy et al. | 296/163 |
| 5,192,111 | 3/1993 | Hanemaayer | 396/163 |
| 5,307,856 | 5/1994 | Murray | 160/70 |
| 5,351,736 | 10/1994 | Laffler et al. | 160/66 |
| 5,407,007 | 4/1995 | Lowrey | 160/22 |
| 5,860,440 | 1/1999 | Murray et al. | 135/88.12 |

*Primary Examiner*—David M. Puror
*Attorney, Agent, or Firm*—Walter A. Hackler

[57] ABSTRACT

The window awning assembly includes an awning and an elongate roller tube for receiving the awning with the awning being rotatably disposed around the roller tube. An elongate awning case is provided which encloses the roller tube and awning, with the roller tube being mounted for rotation within the case. The case includes a main section which is adapted for mounting to a surface and a movable lead rail. The main section and the lead rail engage one another to totally enclose the roller tube and awning when the awning is rolled onto the roller tube. At least two spaced apart support arms are attached between the lead rail and a mounting surface and a coupling system is provided for enabling the support arms to be attached to the lead rail at various positions along the lead rail in order that the lead rail and awning can extend beyond the spacing of the support arms.

22 Claims, 3 Drawing Sheets

FIG. 3.
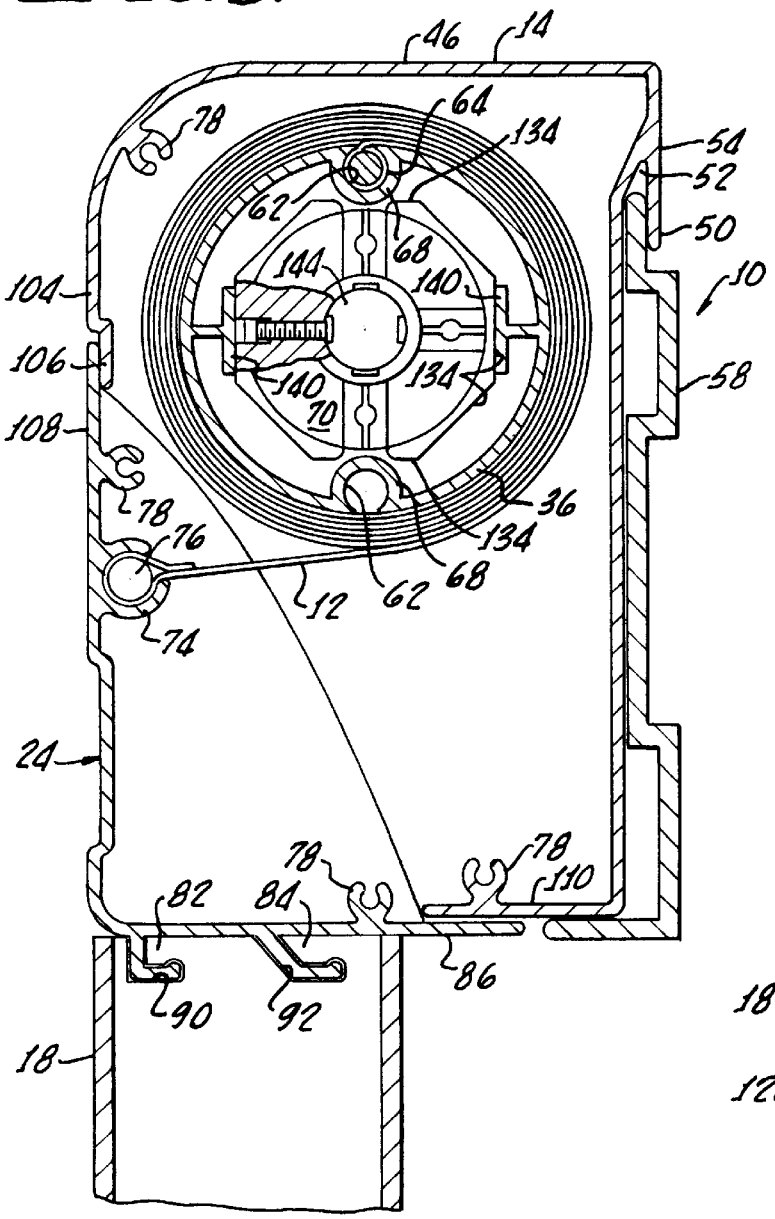
FIG. 5.
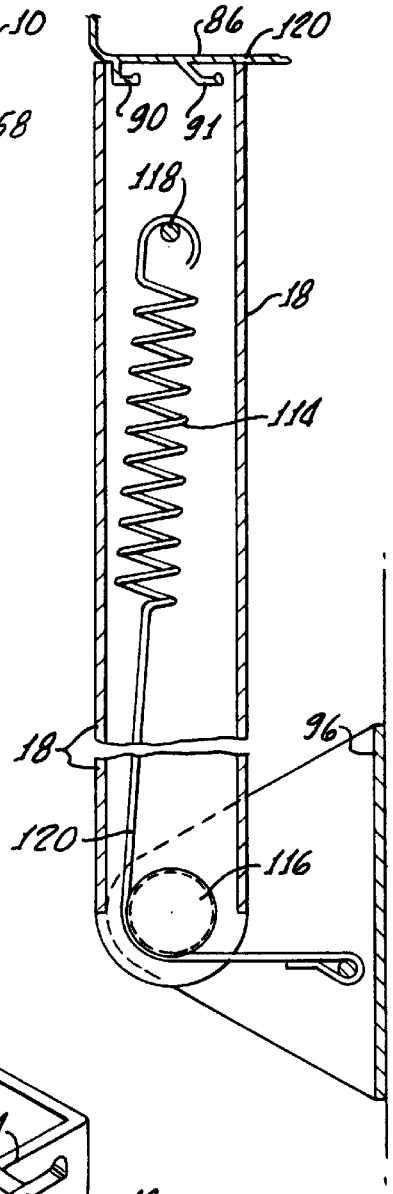
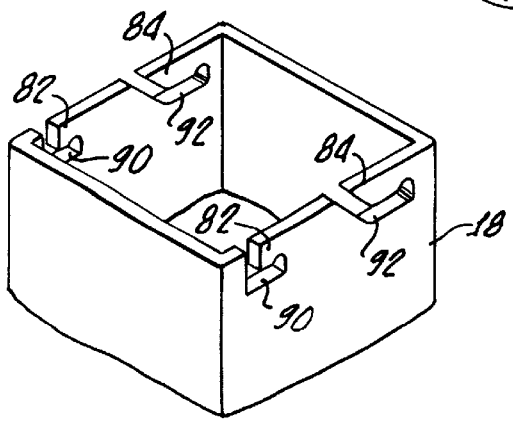
FIG. 4.

CLOSED BOX MOTORIZED WINDOW AWNING

The present invention generally relates to awnings and more particularly relates to motorized retractable, self-storing awning assemblies, suitable for attachment to recreational vehicles, or the like.

Extendible awnings have become a popular accessory for recreational vehicles. Such awning assemblies provide a sheltered area when in an extended position, but are retracted into a housing or case for storage. In the case of awnings for recreational vehicles, it is preferable for the awning to be sealed within the case when closed in order to prevent weather damage to the awning when the vehicle is enroute.

It should be appreciated that high speed travel in recreational vehicles, with or without inclement weather conditions, exposed awnings may be subject to damage. In addition, it is important that the awning be sealed within a case in a manner which does not enable vibrations or rattling thereof during transmit to present a problem to occupants of the vehicle.

Generally, awning assemblies are of two types. One usually employs the housing or case that is mounted on the side of a recreational vehicle to store the rolled awning when not in use.

Another type of awning assembly generally includes a take-up roller which is mounted to a lead bar which moves into an out of the case as the awning is retracted and extended.

Both of these types of awning assemblies may utilize bracing arms or legs which are attached to the side of a recreational vehicle.

It should be appreciated that these arms may not be attached at any position along the side of a recreational vehicle, because a majority of the vehicle sides are not supported by bracing sufficient to enable proper attachment of the support arms thereto. Typically, such arms are attached on either side of a window which includes bracing therearound which is sufficient for attachment of the support arms.

Because of this mounting limitation, and the fact that such arms are attached to ends of the awning assembly, it has heretofore been impossible to provide an awning assembly which extends significantly beyond the width of the window. This is unfortunate in view of the fact that often broader sunshade coverage is desired. A further desirable feature of an awning assembly is the use of a motorized roller. Such motorized rollers can be remotely controlled by a user, thus enabling operation of the awning from inside of the vehicle without requiring mechanical assess through an awning side or a direct manipulation of the awning from outside of the vehicle, which are conventional operational methods.

The present invention solves many of the problems of conventional awning assemblies and provides an awning assembly of any desirable width which may be installed over a window without the necessity of providing structural backup to vehicle panels for support of arms. Thus, the awning assembly in accordance with the present invention may be mounted over a vehicle window independent of the placement of the window frame therein.

SUMMARY OF THE INVENTION

A window awning assembly in accordance with the present invention generally may include an awning having a bead along an edge thereof. An elongate roller tube having at least one internal channel therein may be provided for receiving the awning bead, with the awning being rollably disposed around the roller tube.

An elongate awning case encloses the roller tube and awning, with the roller tube being mounted for rotation within the case. The case includes a main section, adapted for mounting to a surface, and a movable lead rail. The main section and the lead rail engage one another to totally enclose the roller tube and awning when the awning is rolled onto the toller tube. A lead rail is attached to an opposite edge of the awning.

At least two spaced apart support arms are attached between the lead rail and surface with the arms biasing the lead rail away from the surface. Importantly, means are provided for enabling the support arms to be attached to the lead rail at various positions along the lead rail, in order that the lead rail and awning can extend beyond the spacing of the support arms.

A motor may be disposed within the roller tube to provide means for rolling and unrolling the awning.

More particularly, the means for enabling the support arms to be attached to the lead rail may comprise a channel disposed along the lead rail. Preferably, the channel along the lead rail extends the entire length of the lead rail. This enables the arms to be attached at any position along the lead rail, which facilitates attachment of the arms to the surface at selected points where surface support is provided. In addition, this enables the awning to provide a shaded area far greater than the width of the window, a feature which has heretofore not been provided by prior art awning assemblies.

Preferably, the lead rail is L-shaped and the channel is disposed along a bottom surface thereof. With the L-shaped configuration, a bead channel may be provided along an inside surface of an upstanding portion of the lead rail, thereby enabling attachment of the opposite end of the awning thereto, utilizing an awning bead.

The case main section may include a top portion with a depending front face, with the front face including means, defining an indented lip, for receiving the lead rail upstanding portion in a manner providing a flush awning case front. This not only provides an attractive finish for the closed case, but also provides a weather seal.

In that regard, the case main section includes means defining an outwardly extending bottom portion, for slidably engaging the lead rail bottom surface in order to support and stabilize the lead rail in a closed position. This engagement again provides for a very clean look of the enclosed case and also provides not only a weather seal, but a positive engagement between the lead rail and the main case in order to prevent vibration and rattling therebetween.

The roller tube may further include inwardly extending brackets for supporting a motor with the brackets extending inwardly a radial distance approximately equal to the radial distance extended by the roller tube internal channel. This structural configuration enables the round motor or one in a cylindrical housing to be mounted within the roller tube through the use of a motor mounting sleeve. The sleeve includes a circular interior surface for rotatably supporting the motor housing and flat exterior surfaces for engaging flat surfaces on the brackets disposed within the roller tube.

BRIEF DESCRIPTION OF THE DRAWINGS

A more complete understanding of the invention may be had by reference to the following detailed description when taken in conjunction with the accompanying drawings, in which:

FIG. 3 is a cross sectional view of the awning assembly in accordance with the present invention generally showing the roller tube, awning and an awning case which includes a main section and a lead rail, the awning being interconnected between the roller tube and the lead rail and the lead rail bottom surface including a channel for enabling support arms to be attached thereto at various positions therealong;

FIG. 4 is a perspective view of an end of a support arm suitable for coupling to the channels shown on the bottom of the lead rail and slidable therealong, to enable positioning of the support arms at any position along the lead rail;

FIG. 5 is a cross sectional view of a support arm in accordance with the present invention which includes a means for biasing the lead rail outwardly from the surface to which the case is mounted.

DETAILED DESCRIPTION OF THE DRAWINGS

Figure 1:
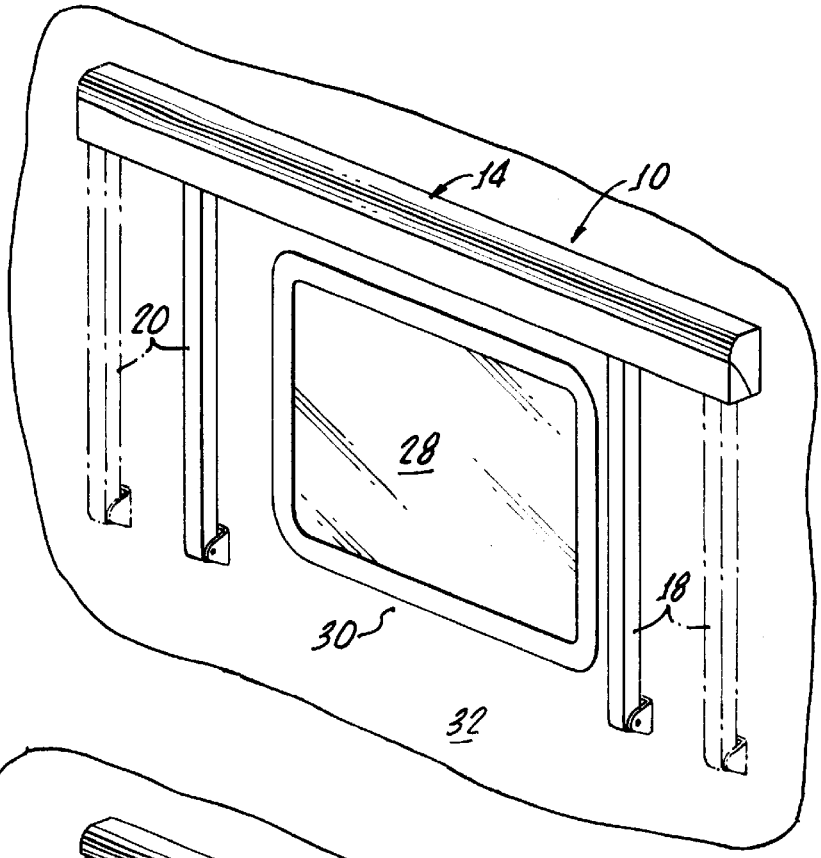
FIG. 1 is a perspective view of the awning assembly in accordance with the present invention as shown in a closed position, with an awning case extending beyond the width of a vehicle window, various positions of the supporting arms being shown in dashed lines.
Figure 2:
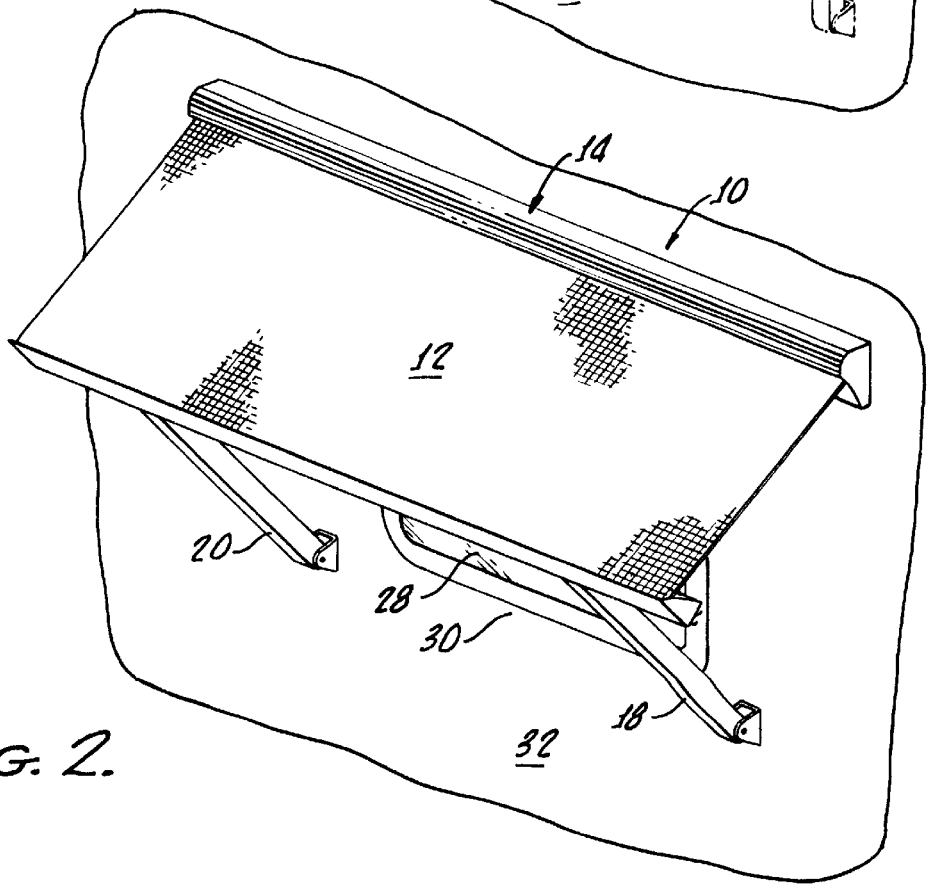
FIG. 2 is a perspective view of the awning assembly as shown in FIG. 1, but in an extended position with the various support arm positions being shown in dashed line.

With reference to FIGS. 1 and 2, there is shown a window awning assembly 10 in accordance with the present invention in a closed and open position, respectively. The assembly 10 generally includes a fabric awning 12 (see FIG. 2) along with an elongate awning case 14 for enclosing the awning 12 in a closed position, along with at least two spaced apart support arms 18, 20.

Alternative positions of the arms 18, 20 are shown in dashed line in FIGS. 1 and 2. As hereinafter discussed in greater detail, the present invention enables attachment of the arms 18, 20 to a lead rail 24 at various positions along the lead rail 24 in order that the lead rail 24 and awning 12 can extend beyond the spacing of the support arms 18, 20. This feature enables, for example, the arms 18, 20 to be mounted next to a window 28 having a window frame 30 therearound, which provides structural support for the attachment of the arm 18, 20 to a vehicle surface 32, or the like. As shown in FIGS. 1 and 2, this enables the awning 12 to extend far beyond the arms 18, 20 to create additional shade for the window 28.

FIG. 3 shows a cross section of the assembly 10 showing an elongate roller tube 36 disposed within the case 14 and rotatably mounted therein between end places 40, 42 (see FIGS. 1 and 2). The roller tube and case may be made from, for example, extruded aluminum, with the case including a main section 46 and the lead rail 24. The main section 46 is adapted for mounting to the surface 32 by a way of a lip 50 and groove 52 formed into a rear 54 of the main section 46 which is sized and shaped for engaging a mounting bracket 58 which may be attached to the surface 32 in any conventional manner.

Preferably, the roller tube 36 includes at least one internal channel 62 for receiving an awning bead 64. Slipping the bead 64 of the awning 12 into the channel 62 securely attaches the awning 12 to the roller tube 36. Other means (not shown) may be utilized for attaching the awning 12 to the roller tube 36. However, in the preferred embodiment, channel walls provide a means for mounting and stabilizing a motor 70 within the roller tube 36, as will be hereinafter discussed in greater detail.

As shown in FIG. 3, the lead rail 24 is generally L-shaped and includes an internal bead channel 74 for receiving an awning bead 36 attached to the awning 12. Other internal channels 78 facilitate attachment of the end plates 40, 42 (not shown in FIG. 3) to the main section 46 and lead rail, respectively, by way of screws (not shown) or the like.

As shown in FIGS. 3 and 4, one or more channels 82, 84 in a bottom 86 of the lead rail 24 and matching grooves 90, 92 and the arms 18, 20 enable the support arms 18, 20 to be attached to the lead rail 24 at various positions along the lead rail 24 as hereinabove referenced and shown in FIGS. 1 and 2. Preferably, the channels 80, 84 extend the entire length of the lead rail 24, thus enabling the arms 18, 20 to slide therealong to any position.

As hereinabove noted, this enables a wider awning to be disposed over a window, but in addition, enables the arms 18, 20 to be attached to the surface by means of brackets 96, with the brackets 96 being optimally positioned over structurally sound portions of the surface 32 supported by, for example, the window frame 30, or any other structural support for the surface, not shown.

It should be appreciated that the channels 82, 84 may be discrete segments disposed along the lead rail bottom 86 or attachment of the arms 18, 20 may be made to the lead rail bottom 86 through a plurality of holes disposed therein or other spaced apart attachment means, all not shown in the Figures. However, it is preferred that the channels 82, 84 are extruded with the lead rail, which may be aluminum, in order to provide means of attachment of the arms 18, 20 to the lead rail at any point therealong, from one end 100 to another end 102. Intermediate selection of the position of the arms 18, 20 is greatly facilitated by the channels 82, 84 inasmuch as the arms, via the grooves 90, 92, may be slid therealong.

Referring again to FIG. 3, the main section 46 of the case 14 includes a depending front face 104 which includes an indented lip 106 which provides a means for receiving an upstanding portion 108 of the lead rail 24 in order that the front portion 104 and the lead rail become nested in a manner providing a relatively flush surface as shown in the Figure. As hereinabove noted, this provides a streamlined case which inhibits entry of the case by moisture or dirt.

The main section 46 also includes an outwardly extending bottom portion which is positioned for slidably engaging the lead rail bottom 86 and provides a means for supporting and stabilizing the lead rail 24 in a closed position. It should be appreciated that FIG. 3 is not drawn to exact proportions. The overlapping nature of the lead rail bottom 86 and main case bottom 110 prevents the entry of dirt and moisture and further provides a positive engagement of the main section 46 and 24 which inhibits vibrational noise from being generated therebetween during transit of the vehicle with the assembly 10 attached thereto.

With reference to FIG. 5, each of the arms 18, 20 only one being shown in FIG. 5, are spring loaded in order to bias the lead rail 24 away from the surface 32. This is structurally accomplished by pivot 116 mounting the arm 18 to the bracket 96 and interconnecting the spring 114 between a pin 118 and a non-yielding cord element 120 which extends around the pivot 116. When in a closed position, as shown in FIG. 5, the spring 114 is stretched and accordingly through the action of the cord 120 and 116 urges a top 120 of the arm, along with the lead rail 24 (not shown in FIG. 5) in an outward direction as indicated by the arrow 122.

Figure 6:
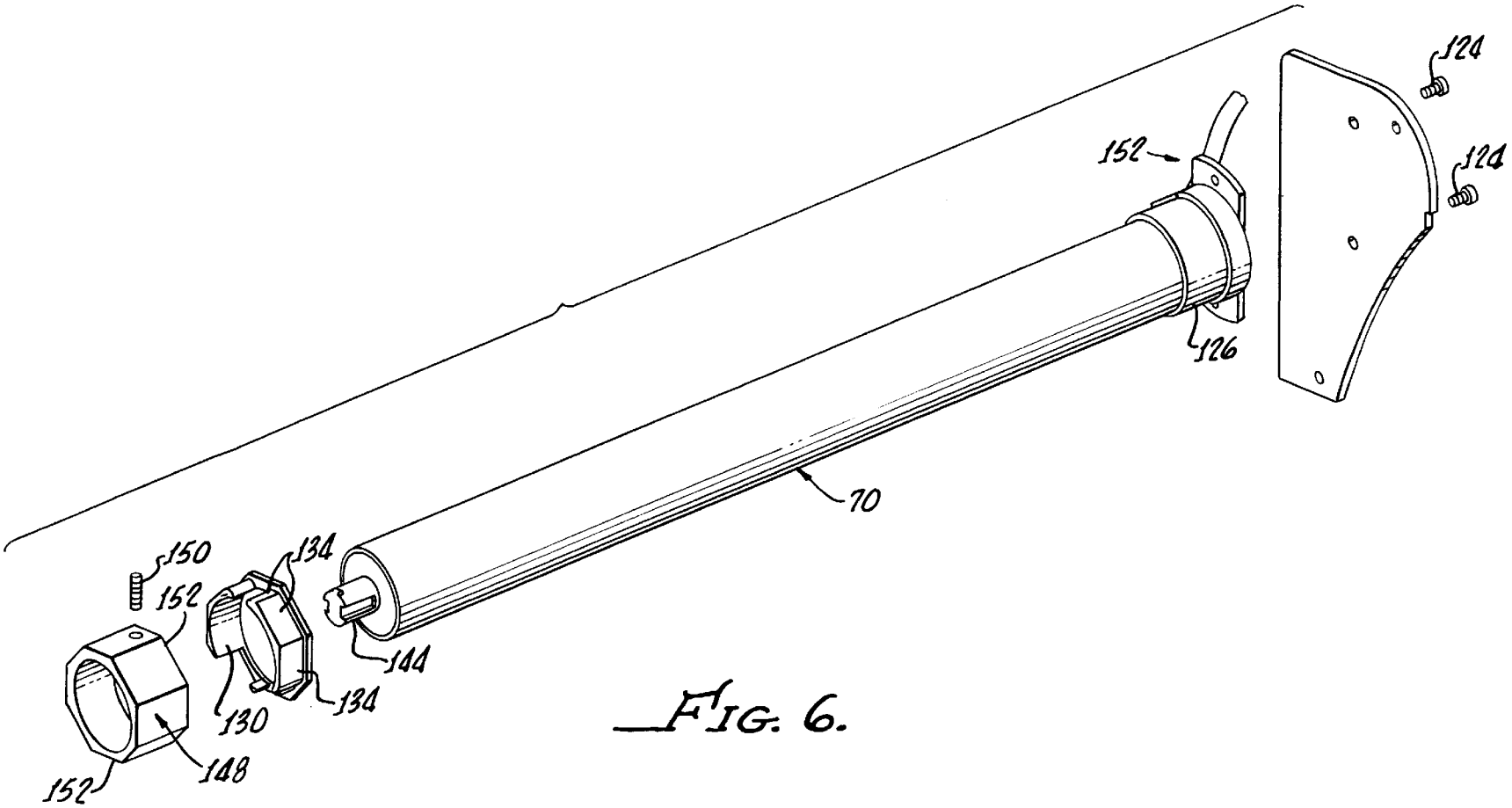
FIG. 6 is a perspective view of a motor assembly suitable for insertion into the roller tube and the rotation thereof by remote control.

The awning 12 may be rolled onto the roller tube 36 or allowed to unwind therefrom through the action of the spring loaded arms 18, 20, via the motor 70, which is more clearly shown in FIG. 6. The motor 70, which may be a conventional design, available from, for example, Simu of Gray, France, is mounted to the end plate 40 by means of screws 124 or the like.

The motor, having a rotatable band 126, is suspended within the roller tube 36, see FIG. 3, by a motor mounting sleeve 128. The sleeve 128 has a circular interior surface 130 for engaging the rotating band 126 and flat exterior surfaces for engaging inwardly extending brackets formed in the roller tube 36.

In addition, one or more of the flat surfaces 34 further engage the channel balls 68 which, in combination with the brackets 140, for suspending the motor 70 within the roller tube 36. Each of the brackets 140 extend inwardly a radial distance approximately equal to a radial distance extended by the internal channel sleeve 68.

Thus, in combination, the brackets 140 and channel walls 68 provide a means for supporting the hexagonal shaped sleeve 128 which, in turn, supports the rotating band 126 within the roller tube 36. This structural feature importantly accommodates the internal channel 64 which enables a positive secure manner of fastening the awning 12 to the roller tube 36 by way of a bead 62 disposed therein. If a circular motor 70 is directly suspended within a roller tube (not shown) not including the channel 62, as is customary in the art, the awning 12 must be fastened to the tube in an inferior manner, such as by screws, snaps or folds, which typically requires additional wrapping around the tube of the awning in order to provide for secure attachment.

The motor 70 rotates the roller tube in either a clockwise or counterclockwise manner by way of a drive shaft 142 fixed to an octagonal drive nut 148 by a set screw 150.

The nut flat surfaces engage the brackets 140 and channel walls 64 in a manner hereinabove described in connection with the sleeve 128. Accordingly, the motor is supported at both ends and with one end 156 of the motor attached to the end piece 40, rotation of the shaft 144 causes the drive nut 148 to rotate the roller tube 36. Control of the motor is accomplished through conventional means, well known in the art.

Although there has been hereinabove described a specific embodiment of a window awning assembly in accordance with the present invention, for the purpose of illustrating the manner in which the invention may be used to advantage, it should be appreciated that the invention is not limited thereto. Accordingly, any and all modification, variations or equivalent arrangements which may occur to those skilled in the art, should be considered to be within the scope of the present invention as defined in the appended claims.

What is claimed is:

1. A window awning assembly comprising:

an awning having a bead along one edge of said awning;

an elongate roller tube having at least one internal channel therein receiving the awning bead, said awning being rollably disposed around the roller tube;

an elongate awning case enclosing the roller tube and awning, the roller tube being mounted for rotation within the case, the case including a main section, adapted for mounting to a surface, and a moveable lead rail, the main section and lead rail engaging one another to totally enclose the roller tube and awning when the awning is rolled onto the roller tube, said lead raid being attached to an opposite edge of said awning;

at least two spring-loaded, spaced apart support arms attached between said lead rail and said surface, the arms bracing the lead rail away from said surface; and means, for enabling the support arms to be attached to said lead rail at various positions along said lead rail in order that the lead rail and awning can extend beyond the spacing of the support arms.

2. The awning assembly according to claim 1 wherein the means for enabling the support arms to be attached to said lead rail comprises a channel disposed along said lead rail.

3. The awning assembly according to claim 2 wherein the channel along said lead rail extends an entire length of said lead rail.

4. The awning assembly according to claim 1 wherein said lead rail is L-shaped and said channel is disposed along a bottom surface thereof.

5. The awning assembly according to claim 4 wherein said awning includes an upstanding portion with a bead channel along an inside surface thereof for receiving the awning opposite edge.

6. The awning assembly according to claim 1 wherein the case main section includes a top portion with a depending front face, the front face including means, defining an indented lip, for receiving the lead rail upstanding portion in a manner providing a flush awning case front.

7. The awning assembly according to claim 6 wherein the case main section includes means, defining an outwardly extending bottom portion, for slidably engaging the lead rail bottom surface in order to support and stabilize the lead rail in a closed position.

8. A window awning assembly comprising:

an awning having a bead along one edge of said awning;

an elongate roller tube having at least one internal channel therein for receiving the awning bead, said awning being rollably disposed around the roller tube;

an elongate awning case enclosing the roller tube and awning, the roller tube being mounted for rotation within the case, the case including a main section, adapted for mounting to a surface, and a moveable lead rail, the main section and lead rail engaging one another to totally enclose the roller tube and awning when the awning is rolled onto the roller tube, said lead rail being attached to an opposite edge of said awning;

at least two spring-loaded, spaced apart support arms attached between said lead rail and said surface, the arms biasing the lead rail from said surface;

means for enabling the support arms to be attached to said lead rail at various positions along said lead rail in order that the lead rail and awning can extend beyond the spacing of the support arms; and motor means, disposed within the roller tube, for rolling and unrolling said awning.

9. The awning assembly according to claim 8 wherein the means for enabling the support arms to be attached to said lead rail comprises a channel disposed along said lead rail.

10. The awning assembly according to claim 9 wherein the channel along said lead rail extends an entire length of said lead rail.

11. The awning assembly according to claim 8 wherein said lead rail is L-shaped and said channel is disposed along a bottom surface thereof.

12. The awning assembly according to claim 11 wherein said awning includes a bead along the opposite end thereof and said lead rail includes an upstanding position with a bead channel along an inside surface thereof for receiving the opposite end bead.

13. The awning assembly according to claim 12 wherein the roller tube further comprises inwardly extending brackets for supporting said motor means.

14. The awning assembly according to claim 13 wherein the brackets extend inwardly a radial distance approximately equal to a radial distance extended by the internal channel.

15. The awning assembly according to claim 14, said motor means including a round cylindrical housing and the awning assembly further comprises a motor mounting sleeve, the sleeve having a circular interior surface for rotatably supporting the motor means housing.

16. The awning assembly according to claim 15 wherein the sleeve includes flat exterior surfaces and the brackets include flat surfaces for engaging the sleeve flat exterior surfaces.

17. The awning assembly according to claim 8 wherein the case main section includes a top portion with a depending front face, the front face including means, defining an indented lip, for receiving the lead rail upstanding portion in a manner providing a flush awning case front.

18. The awning assembly according to claim 17 wherein the case main section includes means, defining an outwardly extending bottom portion, for slidably engaging the lead rail bottom surface in order to support and stabilize the lead rail in a closed position.

19. A window awning assembly comprising:

an awning;

an elongate roller tube for receiving the awning, said awning being rollably disposed around the roller tube;

an elongate awning case enclosing the roller tube and awning, the roller tube being mounted for rotation within the case, the case including a main section, adapted for mounting to a surface, and a moveable lead rail, the main section and lead rail engaging one another to totally enclose the roller tube and awning when the awning is rolled onto the roller tube, said lead rail being attached to an opposite edge of said awning;

at least two spaced apart support arms attached between said lead rail and said surface; and means, for enabling the support arms to be attached to said lead rail at various positions along said lead rail in order that the lead rail and awning can extend beyond the spacing of the support arms.

20. The awning assembly according to claim 19 wherein the means for enabling the support arms to be attached to said lead rail comprises a channel disposed along said lead rail.

21. The awning assembly according to claim 20 wherein the channel along said lead rail extends an entire length of said lead rail.

22. The awning assembly according to claim 21 wherein said lead rail is L-shaped and said channel is disposed along a bottom surface thereof.

* * * * *